US005312090A

United States Patent [19]

Seaton et al.

[11] Patent Number: 5,312,090

[45] Date of Patent: May 17, 1994

[54] APPARATUS AND METHOD FOR CONTROLLING A STOPPER ROD OF A BOTTOM POURING VESSEL

[75] Inventors: William W. Seaton, Dexter; Richard A. Gillette, West Branch; Mark T. Salgat, Pinconning, all of Mich.

[73] Assignee: CMI International, Southfield, Mich.

[21] Appl. No.: 992,262

[22] Filed: Dec. 14, 1992

[51] Int. Cl.[5] ..... B22D 41/20

[52] U.S. Cl. ..... 266/45; 266/78; 266/236; 222/602

[58] Field of Search ..... 266/78, 236, 45; 222/602, 590, 591

[56] References Cited

U.S. PATENT DOCUMENTS

| | | | |
|---|---|---|---|
| 2,902,188 | 9/1959 | Tarukawa | 222/509 |
| 3,331,539 | 7/1967 | Cofer et al. | 222/602 |
| 3,643,680 | 2/1972 | Hall et al. | 164/337 |
| 3,703,248 | 11/1972 | Seaton | 222/602 |
| 3,733,014 | 5/1973 | Pflaum | 222/602 |
| 3,744,684 | 7/1973 | Heimgartner | 222/509 |
| 3,762,605 | 10/1975 | Seaton | 222/602 |
| 3,786,962 | 1/1974 | VanLinder | 164/337 |
| 3,952,922 | 4/1976 | Ditto et al. | 222/602 |
| 4,155,492 | 5/1979 | Seaton | 222/592 |
| 4,196,829 | 4/1980 | Seaton | 222/602 |
| 4,258,868 | 3/1981 | Drysh | 222/602 |
| 4,271,994 | 6/1981 | Seaton | 222/602 |
| 4,410,112 | 10/1983 | Fasano et al. | 222/602 |
| 4,744,407 | 5/1988 | Fishman et al. | 164/457 |
| 4,953,761 | 9/1990 | Fishman et al. | 222/602 |

FOREIGN PATENT DOCUMENTS 1380860 3/1986 U.S.S.R. .

*Primary Examiner*—Scott Kastler

*Attorney, Agent, or Firm*—Reising, Ethington, Barnard, Perry & Milton

[57] ABSTRACT

A bottom pour casting apparatus (100) includes a vessel (114) having a bottom nozzle (118). A stopper rod (112) is coupled to a programmable controller (250) by linkage mechanism (250) for controlling the movement of the stopper rod (112) according to a pouring schedule. An LDT position sensor (216) is coupled to the stopper rod (112) by a cable (238) and also electronically to the controller (250) for sensing the actual position of the stopper rod during a pouring cycle and conveying this information directly to the controller (250) thereby bypassing any backlash present in the linkage mechanism (116) to enable precise control of the stopper rod movement. A method includes rezeroing the position sensor (116) at the beginning of each pouring cycle to account for slag build-up on the nozzle (118).

27 Claims, 3 Drawing Sheets

APPARATUS AND METHOD FOR CONTROLLING A STOPPER ROD OF A BOTTOM POURING VESSEL

BACKGROUND OF THE INVENTION

1. Technical Field

This invention relates generally to metal casting control devices and methods for controlling the pour of molten metal into molds and, more specifically, to an apparatus and method for controlling the positioning of a stopper rod of a bottom pour casting vessel.

2. Related Prior Art

Accurate control of the opening and closing of a stopper rod of a bottom pour casting vessel is essential for producing high quality metal castings. A typical stopper rod control mechanism in present day use and manufactured by the assignee of the present invention for pouring molten iron is shown in FIG. 1 and comprises a bottom pouring vessel having a bottom nozzle and a stopper rod extending into the vessel for communicating with the nozzle. A hydraulic cylinder remotely controls the movement of the stopper rod through a parallelogram linkage mechanism having six pivot points A programmable controller controls actuation of the hydraulic cylinder through a digital proportioning valve. The cylinder is provided with a digital encoder which measures movement of a rod of the cylinder commanded by the digital valve.

With all bottom pour casting systems, it is imperative that the movement and position of the stopper rod be precisely controlled since it is the stopper rod that governs the flow of molten metal through the nozzle. The prior art system of FIG. 1 relies on the digital encoder of the hydraulic cylinder to sense the position and stroke of the stopper rod. A problem arises, however, in that each pivot point of the linkage mechanism has a certain amount of "slop" or movement incorporated in its design which is necessary to avoid tight fits in the high temperature environment in which the mechanism operates. The accumulated slop of the pivot points can translate to an error of 0.30 to 0.70 inches between actual movement of the stopper rod and the movement sensed by the encoder. The solution heretofore has been to add a "slop factor" into the logic of a programmable controller to compensate for the error. This factor anticipates the amount of slop and compensates in terms of the stroke commands provided to the stop. There is a problem, however, in that the amount of slop varies with temperature. Varying metal level in the vessel adds to the control problems by changing the buoyancy forces on the stopper rod. Because of these problems, it is presently necessary to periodically update the slop factor thereby requiring constant monitoring of the pouring system.

The controller of the prior art pouring apparatus of FIG. 1 is programmed to raise and lower the stop rod in relation to the nozzle according to a predetermined pouring schedule characteristic of the mold being poured. Each casting cycle begins with the stopper rod in a fully closed position against the nozzle. The controller controls movement of the stopper rod according to the pouring schedule in relation to the fully closed position of the stopper rod. A problem rises, however, in that over time slag and other impurities build up on the nozzle which changes the actual position of the stopper rod when in the fully closed position. This adversely affects the ability of the prior art control system to control movement of the stopper rod since the changing fully closed reference position of the stopper rod is not taken into account.

The U.S. Pat. No. 4,953,761 to Fishman et al, granted Sep. 4, 1990 recognizes slag formation on the nozzle but proposes to resolve such problems by increasing the seating force of the rod so that the slag can be crushed off the nozzle enabling the stopper rod to regain its original fully closed reference position before build up. Applying excessive force to the nozzle, however, can damage both the nozzle and the rod and hence such a practice is to be avoided.

SUMMARY OF THE INVENTION AND ADVANTAGES

Apparatus for controlling molten metal discharge through a nozzle of a bottom pouring vessel comprises a stopper rod, linkage means supporting the stopper rod for axial movement relative to the nozzle, primary actuating means coupled to the stopper rod by the linkage means for raising and lowering the stopper rod to positions relative to the nozzle in response to moving the actuating means to corresponding positions for regulating the flow of molten metal through the nozzle into an underlying casting mold, and stopper rod feedback control means for sensing the actual position of the stopper rod irrespective of the position of the actuating means and controlling movement of the actuating means for conforming the actual stopper rod position with a target reference position of the feedback control means to compensate for any backlash present in the linkage means.

By sensing the actual position of the stopper rod irrespective of the position of the actuating means, the stopper rod feedback control means of this invention bypasses the slop of the linkage mechanism resulting in improved stopper rod control at a savings to the user in greater casting yield per mold, less spillage, and fewer scrap castings.

The invention also contemplates a method of controlling the pour of molten metal from a bottom pour casting apparatus into successive underlying molds; in which the apparatus includes a pouring vessel provided with a bottom nozzle, a stopper rod extending into the vessel for communicating with the nozzle, and a stopper rod control mechanism which is programmable for raising and lowering the stopper rod in relation to a zero reference position of the stopper rod corresponding to a fully closed condition of the stopper rod wherein the stopper rod is seated against the nozzle. The method comprises the steps of sensing the actual position of the stopper rod when in the fully closed condition before each pouring cycle commences and sending a signal to the stopper rod control mechanism for each pouring cycle, and thereafter controlling the movement of the stopper rod in relation to the characteristic zero reference position for each pouring cycle.

The method of the present invention adjusts for changes in the actual zero reference position resulting from a build up of slag on the nozzle by sensing the actual fully closed position of the stopper rod for each pouring cycle and providing the control mechanism with this information to enable adjustment in stopper rod control. With this method, there is no need to crush the slag deposits of the nozzle to maintain control, as with the prior art methods.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
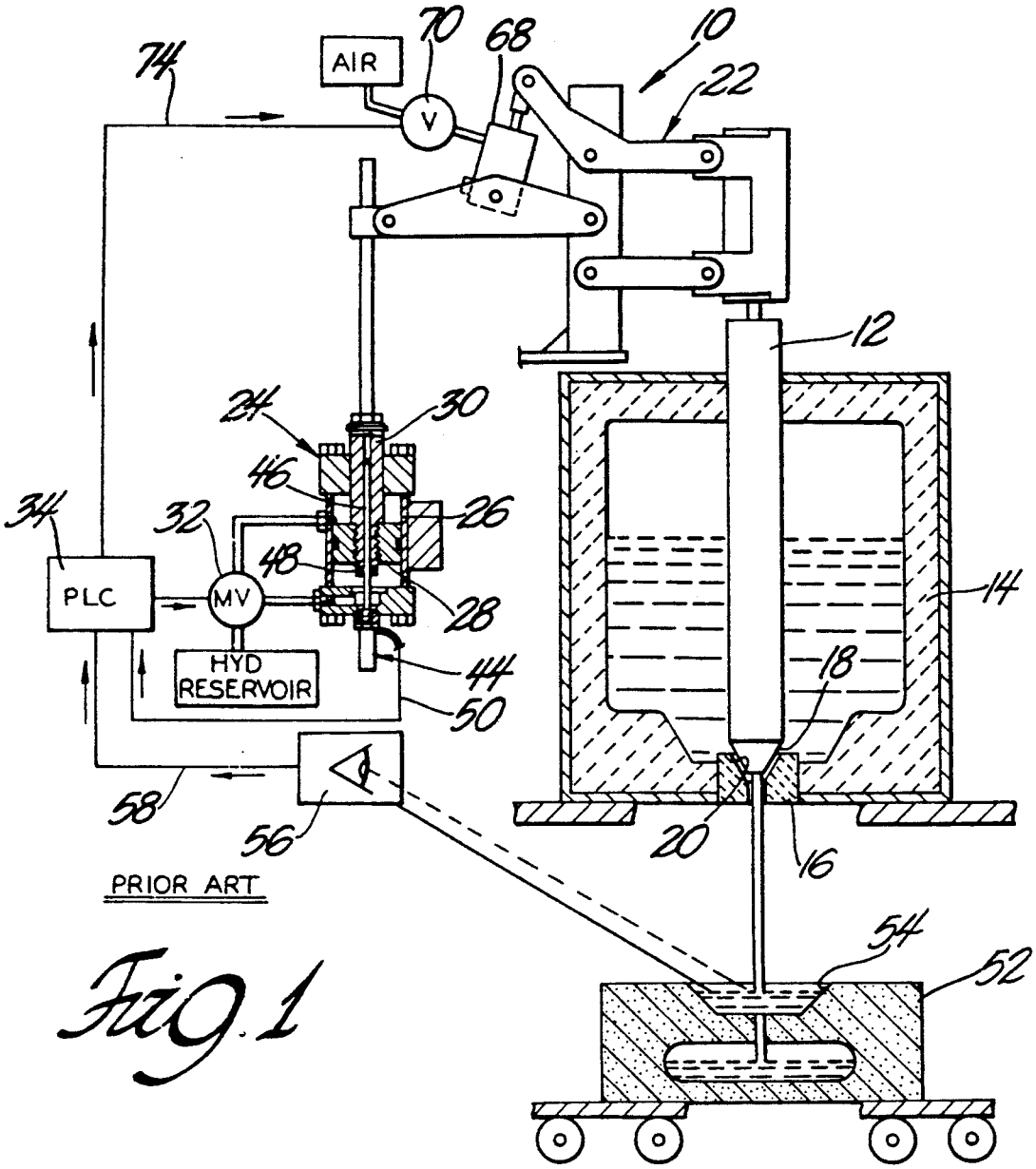
PRIOR ART Fig. 1
FIG. 1 is an elevational view, partly in section, of a prior art bottom pouring apparatus.
Figure 2:
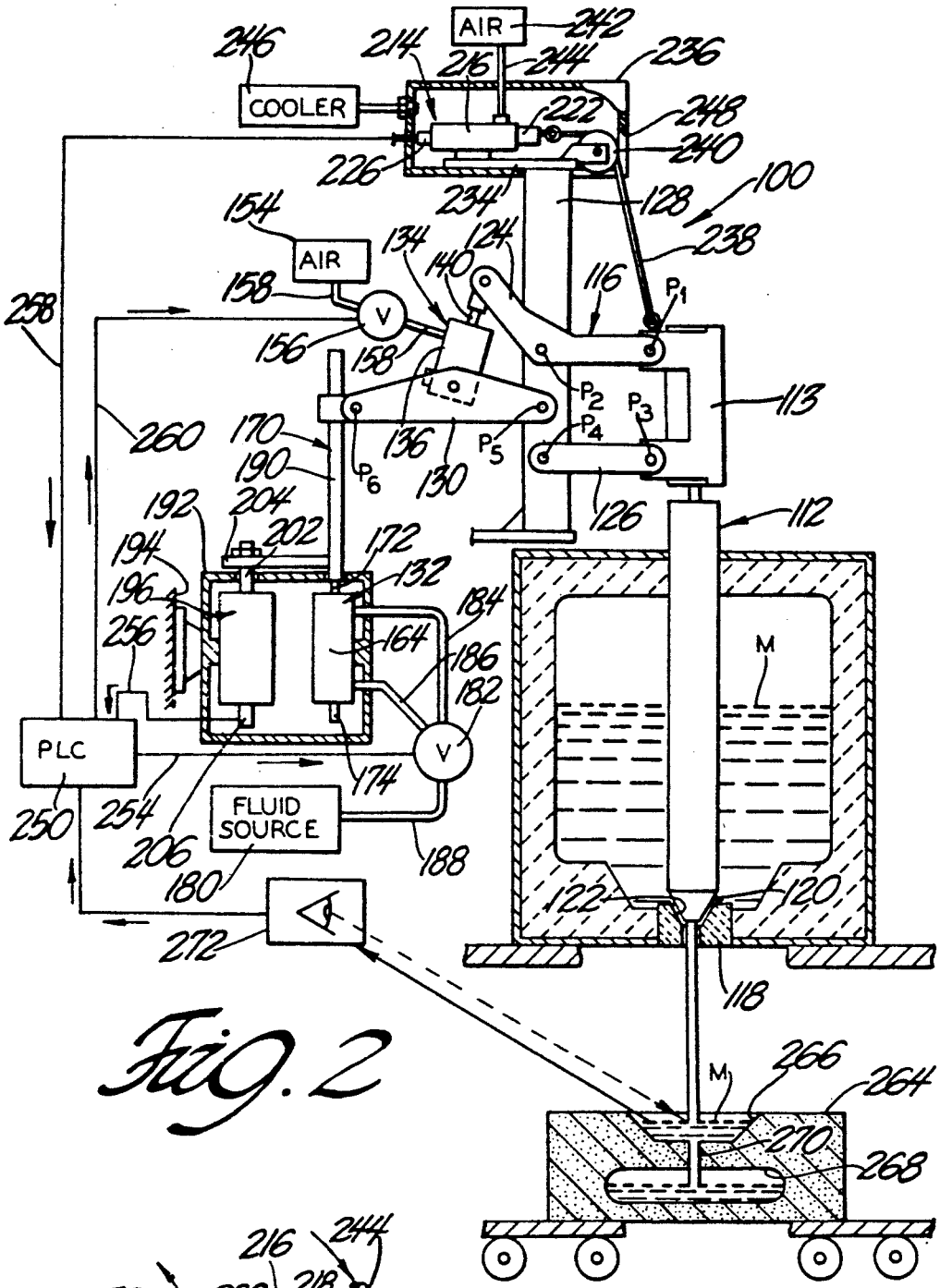
FIG. 2 is an elevational view, partly in section, of a bottom pouring apparatus constructed according to the invention.
Figure 3:
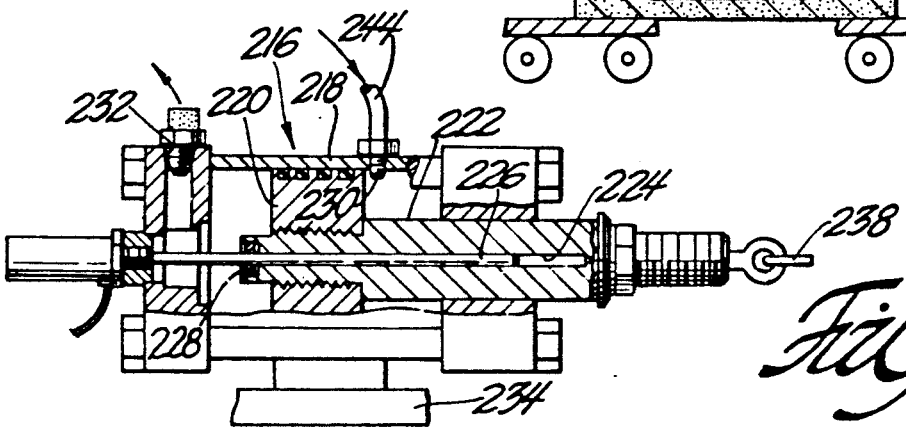
FIG. 3 is an elevational view shown partly in section of the stopper rod position sensor.

A stopper rod control apparatus constructed in accordance with the present invention for controlling the pour of molten metal into molds is generally shown at 100 in FIG. 2 and is an improvement over the prior art control apparatus indicated generally at 10 in FIG. 1.

The prior art apparatus 10 includes a stopper rod 12 extending into a pouring vessel 14 containing a supply of molten metal, such as molten iron. The vessel 14 is provided with a bottom nozzle 16 which serves as an outlet for the metal. The stopper rod 12 and nozzle 16 have mating conical seating surfaces 18, 20, respectively, which, when engaged, prevent the flow of metal through the nozzle 16.

The stopper rod 12 is supported by a parallelogram linkage mechanism, generally indicated at 22 for enabling the stopper rod 12 to reciprocate axially toward and away from the nozzle 16 to regulate the flow of metal therethrough. The linkage mechanism 22 is of the type shown and disclosed in a prior U.S. Pat. No. 4,196,829, granted Apr. 8, 1980 in the name of William Seaton, one of the inventors named herein. This patent is incorporated herein by reference.

A primary actuating device 24 is remotely coupled to the stopper rod 12 by the linkage mechanism 22. The device 24 is a hydraulic piston/cylinder arrangement comprising a hollow cylindrical housing 26 inside of which is slideably disposed a piston 28 mounted securely to an actuating rod 30 extending through the housing 26 and attached to the linkage mechanism 22.

Actuation of the device 24 is controlled by an electronic digital modulating valve 32 which is in turn controlled by a programmable logic controller (PLC) 34.

A linear displacement transducer (LDT) 44 is formed integrally with the actuating device 24 and comprises a probe 46 extending into the bottom of the cylinder housing 26 and slideably received within a passageway inside the rod 30. A magnet 48 is mounted to the end of the rod 30 and moveable therewith with respect to the probe 46 for sensing the linear displacement of the rod 30. The LDT 44 sends position signal information to the PLC 34 through line 50.

Figure 7:
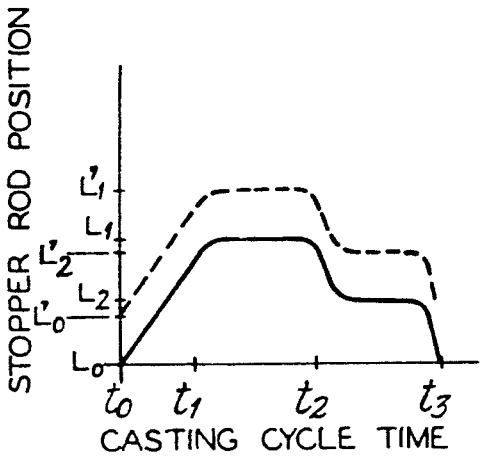
FIG. 7 is a diagrammatic representation of a pouring cycle.

A casting mold 52 is supported beneath the vessel 14 and has a pouring basin 54 positioned directly beneath the nozzle 16 such that when metal is discharged on the nozzle 16 it pours into the basin 54. An optical imaging sensor 56 continuously senses the level of metal in the basin 54 and communicates the information to the PLC 34 through line 58. The PLC 34 is programmed with pour schedule information corresponding to a targeted metal level in the basin 54 as a function of casting cycle time which in turn directly relates to the positioning of the stopper rod 12 above the nozzle 16 as a function of casting cycle time. A representative pouring schedule is shown in FIG. 7.

The linkage mechanism 22 includes first and second linkages interconnected by a secondary pneumatic actuating cylinder 68 of the type disclosed in the prior United States '829 patent. Actuation of the cylinder 68 is controlled by a valve 70 which is in turn controlled by the PLC 34 through line 74.

In operation, the PLC 34 is programmed with the pouring cycle information characteristic of the casting being poured. Pouring begins by actuating cylinder 68 which raises the stopper rod 12 a predetermined distance above the level of nozzle 16 via the first linkage and establishes a rigid mechanical connection between the first and second linkages. Thereafter, movement of the stopper rod 12 is controlled by the primary actuating device 24.

Once cylinder 68 is actuated, the imaging sensor 56 monitors the level of the metal in the pouring basin 54 and communicates this information to the PLC 34. The PLC 34 compares this information to the pouring schedule and makes necessary changes in the position of the stopper rod 12 by either raising or lowering the actuating rod 30 to bring its position into conformance with the pouring schedule. More specifically, when adjustment of the stopper rod position is necessary, the PLC sends a control signal to the modulating valve 32 which in turn injects hydraulic fluid into the cylinder housing 26 on the appropriate side of the piston 28 to either raise or lower the actuating rod 30 by a specific amount. The LDT 44 monitors the displacement of the rod 30 and signals the PLC 34 when the appropriate position of the actuating rod 30 has been reached.

Ideally, displacement of actuating rod 30 corresponds one-to-one with the displacement of the stopper rod 12. However, because the linkage mechanism 22 has pivot connection points that are designed with a certain amount of play or backlash (i.e., "slop") to accommodate temperature changes, such a one-to-one relationship does not exist. The movement and position of the actuating rod 30 does not correspond directly to the movement and position of the stopper rod 12. Consequently, the actuating rod displacement information provided to the PLC 34 by the LDT 44 is not necessarily representative of the actual displacement and position of the stopper rod 12. Thus, accurate positioning of the stopper rod 12 cannot be controlled simply by monitoring and controlling the positioning of the actuating rod 30 alone.

Another problem encountered with operation of the prior art pouring device is that, over time, slag and other impurities tend to deposit on the seating surfaces 18, 20 of the stopper rod 12 and nozzle 16 which, in turn, changes the location of the stopper rod 12 (i.e., raises it) when in the fully closed condition. This further hinders control of the stopper rod 12 since the PLC 34 relies on an unchanging fully closed stopper rod position from which to base control of the stopper rod 12 position according to the pouring schedule.

Another problem arises by combining the actuating device 24 and LDT 44. Because of the large cross-sectional differences between the actuating rod 30 and the probe 46, there is much less surface area on the upper side of the piston 28 as compared to the lower side. As a result, the device 24 reacts much more quickly when adjustments are made to lift the stopper rod 12 as compared to lowering the stopper rod 12. This difference in reaction time further adds to the difficulties inaccurately controlling the positioning of the stopper rod 12.

The present metal pouring apparatus 100 is an improvement over the prior art apparatus shown and described in FIG. 1.

The improved apparatus 10 similarly includes a stopper rod 12 of generally cylindrical configuration extending axially between opposite ends. A mounting bracket 113 is fixed to an upper end of the stopper rod 112 and connected pivotally to a linkage means or mechanism 116 for supporting the stopper rod 112 vertically with a lower end thereof extending down into a pouring vessel 114 for enabling the stopper rod 112 to reciprocate vertically along its axis in relation to a nozzle 118 disposed in the bottom of the vessel 114 and serving as an outlet for molten metal M contained in the vessel 114. The rod 112 and nozzle 118 include complemental conical seating surfaces 120, 122, respectively, which, when engaged, prevent metal from flowing through the nozzle 118.

The linkage mechanism 116 is substantially identical to the one disclosed in the aforementioned U.S. Pat. No. 4,196,829 to Seaton. The linkage mechanism 116 includes a first four point linkage including an upper dog leg lever 124 having opposite ends and a lower lever 126 having opposite ends which together pivotally couple the stopper rod 112 to a stationary vertical support post 128 by four pivot point connections, indicated at $P_1$–$P_4$ in FIG. 2. More specifically, the lever 124 is angled between its ends and has one of its ends connected pivotally to the stopper rod mounting bracket 113 by a pivot pin connection $P_1$ and is further pivotally coupled to the support post 128 at a location intermediate its ends by a second pivot connection $P_2$. The lower lever 126 has one of its ends connected pivotally to the stopper rod mounting bracket 113 by a third pivot pin connection $P_3$ and the other end pivotally coupled to the support post 128 by a fourth pivot pin connection $P_4$. The lower lever 126 is parallel to the portion of the upper lever extending between the stopper rod 112 and support 128.

The linkage mechanism 116 also includes a second linkage comprised of an intermediate lever 130 having opposite ends, one of which is connected pivotally to the support post 128 by a fifth pivot pin connection $P_5$ at a location between the upper and lower legs 124, 126 and an opposite end of which is coupled pivotally to a primary actuating means 130 by a sixth pivot pin connection $P_6$.

Secondary actuating means 134 interconnects the first and second linkages for enabling pivotal movement of the first linkage independently of the second linkage when in an operative condition for controlling the movement of the stopper rod 112 independent of the operation of the primary actuating means 132 and for forming a direct mechanical rigid connection between the first and second linkages when in an inoperative condition for transmitting motion between the first and second linkages to enable the primary actuating means 132 to control movement of the stopper rod 112.

The secondary actuating means 134 preferably comprises a single acting pneumatic cylinder 134 having a hollow cylindrical housing 136 coupled pivotally to the intermediate lever 130 at a location between the ends of lever 130. Inside the housing 130 is a piston 138 coupled to a rod 140 which extends from the housing 136 and is coupled pivotally to the remaining end of the upper dog leg lever 124 (i.e., the end opposite the stopper rod 112). The housing 136 includes an upper wall 142 and a lower wall 144. A stop 146 projects upwardly from the lower wall 144 to a distal end spaced from the upper wall 142 of the housing 136 and forming a stop surface 148. The piston 138 is accommodated between the upper wall 142 and the stop surface 148 and is slideable axially between a fully raised position in which the piston 138 is engaging the upper wall 142 and a fully lowered position in which the piston 138 is engaging the stop surface 148 and thereby establishing the aforementioned rigid mechanical connection between the first and second linkages. A coil spring 150 is disposed in the housing 136 and acts between the lower wall 144 and the underside of the piston 138 to continuously bias the piston 138 and rod 140 toward the fully raised position.

The cylinder 134 also includes an air inlet port 150 coupled to an air supply 152 and an electronically controlled solenoid valve 154 through lines 156 for selectively admitting air (or other fluid) into the housing 136 above the piston 138 with sufficient pressure of force to overcome the biasing force of the coil spring 150 so as to force the piston 148 against the stop surface 148. An air outlet port 160 is provided in the housing 136 below the piston 138 for exhausting air from the cylinder 138 as the piston 138 moves toward engagement with the stop surface 148. A filter 160 prevents debris from entering the cylinder 134.

When the cylinder 134 is connected to the linkage mechanism 116 in the manner shown in FIG. 1, the housing 136 forms an extension of the intermediate lever 130 and hence is moveable therewith, and the piston and rod assembly 138, 140 form an extension of the upper dog leg lever 124 and hence is movable therewith.

The primary actuating means 132 preferably comprises a fluid power cylinder and particularly a hydraulic cylinder 164. As seen best in FIG. 5, the cylinder 164 includes a hollow housing 166 inside of which is slideably disposed a piston 168 coupled to a double extending rod 170 having upper 172 and lower 174 portions thereof extending from opposite sides of the piston 168 through openings in the housing 166. Upper and lower fluid inlets 176 and 178 are provided in the housing 166 at locations above and below the piston 168, respectively, and are coupled to a hydraulic fluid force 180 and an electronically controlled modulating or proportional valve 182 through lines 184, 186 and 188. The rod 170 also includes an extension portion 190 threadably coupled or otherwise secured at one end thereof to the portion 172 and pivotally coupled at an opposite end to the intermediate lever 130. The connection between the intermediate lever 130 and the extension 190 may be adjustable, as taught by the aforementioned U.S. Pat. No. 4,196,829. When fully connected, the actuating rod 170 extends generally parallel to and is spaced from the stopper rod 112.

The upper and lower rod portions 172, 174 are substantially equal in cross sectional size so that the piston 168 is equal acting when raising and lowering the rod 170. That is, the upper surface area of the piston 168 confronting the hydraulic fluid introduced into the upper inlet 176 is equal to the lower piston area confronting the fluid introduced into the lower outlet 178. In this way, the travel speed for the piston and rod assembly 168, 170 is equal whether being raised or lowered.

The cylinder 164 is mounted within a protective enclosure 192 which is in turn mounted to a stationary support structure 194. The housing 166 is fixed with respect to support structure 194 such as by attaching the housing 166 to the inner wall of the enclosure 192, as seen in FIG. 2. The enclosure 192 shields the cylinder 164 from exposure to the heat of the molten metal M and hence protects it against damage.

The assembly 110 further includes actuating rod position sensing means in the preferred form of a linear displacement transducer (LDT) 196 coupled in parallel to the actuating rod 170 for sensing the position of the actuating rod 170 and generating feedback information representative of the actuating rod position. A preferred LDT 196 is the Parkertron LDT available commercially from Parker Hanifin Corporation of Cleveland, Ohio.

The LDT 196 is also mounted within the protective enclosure 192 and has a hollow housing 198 fixed with respect to the support structure 194, such as by mounting the housing 198 to the enclosure wall, as shown in FIG. 2. A piston 200 is disposed within the housing 198 and is free to slide therein The piston 200 is secured to a rod 202 which extends through the top of the housing 198 and is substantially parallel to and spaced from the actuating rod 170 of hydraulic cylinder 164. A cross member 204 extends transversely between and is rigidly connected to both the hydraulic cylinder rod 170 and LDT rod 202 whereby movement of the hydraulic cylinder rod 170 produces an equivalent movement of the LDT rod 202. Hence, the rods 170 and 202 are connected in parallel via the cross member 204. A stainless steel probe 206 is secured to the housing 198 and extends into a longitudinal passageway 208 within the rod 202

Figure 5:
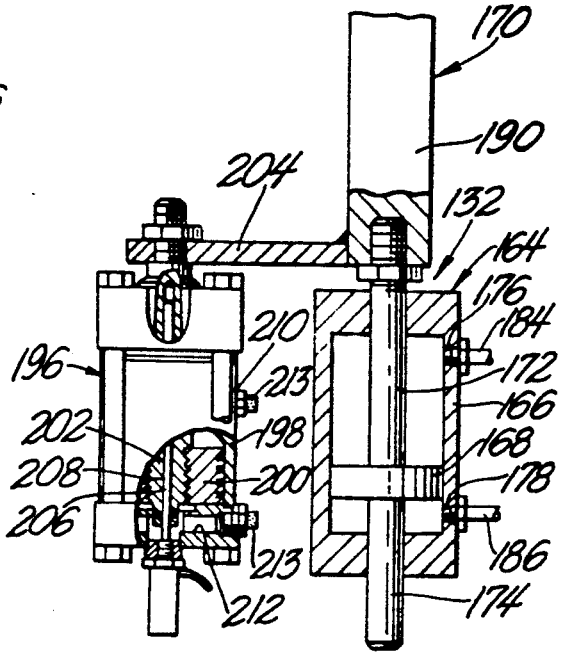
FIG. 5 is in elevational view, shown partly in section of the primary actuating mechanism and actuating rod position sensing device.

A magnet 210 is secured to the rod 202 and moveable therewith in relation to the probe 206 to sense the movement and exact linear displacement or position of the actuating rod 170 with respect to a zero reference position of the rod 202. The LDT 196 is substantially identical in construction to the combined LDT/actuating device 44/24 of the prior art apparatus of FIG. 1, except that the piston 200 of the present apparatus 100 is not used to control movement of the actuating rod 170, but rather is used only to sense the linear displacement of the rod 170. As shown in FIG. 5, the housing 198 includes upper and lower fluid ports 210, 212 which are not connected to any pressurized fluid source but rather vented to the atmosphere. Each of the ports 210, 212 is provided with filters 213 to prevent debris from entering the housing 198.

As with the prior art linkage mechanism 22 described above, the linkage mechanism 116 of the present apparatus 100 has a certain amount of looseness or backlash (i.e., "slop") designed into the pivot point connections $P_1$–$P_6$ for accommodating various extreme operating temperatures.

The present apparatus 100 overcomes the aforementioned stopper rod control problems attributable to the linkage backlash by providing stopper rod feedback control means 214 for sensing the actual position of the stopper rod 112 irrespective of the position of the actuating rod 170 and controlling the movement of the actuating rod 170 for conforming the actual stopper rod position with a target reference position according to a pouring schedule (such as the one shown in FIG. 7) of the feedback control means 214 to compensate for any backlash present in the linkage mechanism 116.

The feedback control means 214 includes a stopper rod position sensor 216 substantially identical in construction to the sensor 196 associated with the hydraulic cylinder 164. As such, the stopper rod position sensor 216 comprises an LDT having a housing 218, a piston 220, a rod 222, internal passageway 224, probe 226, magnet 228, and inlet ports 230, 232 on the rod and probe side of the piston 22, respectively. The LDT 216 is mounted on a platform 234 of the support post 128 and substantially surrounded by a protective enclosure 236, 236' which shields the sensor 216 from exposure to the heat of the metal M. The platform 234 is substantially horizontal and the sensor 216 is supported substantially horizontally as well.

Figure 6:
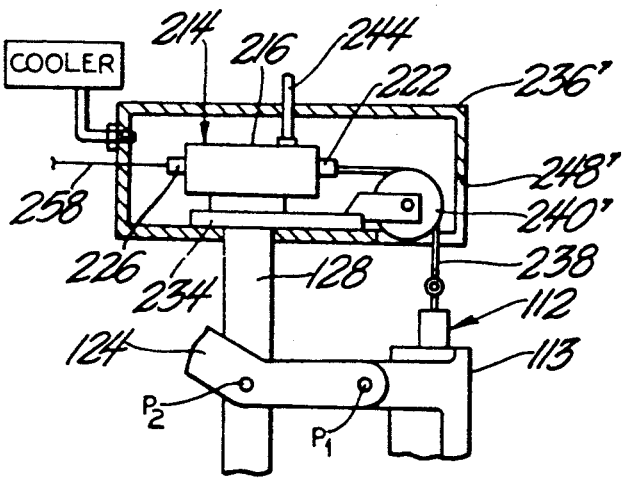
FIG. 6 is an elevational view, shown partly in section, of an alternative connection arrangement between the stopper rod and position sensor.
Figure 8:
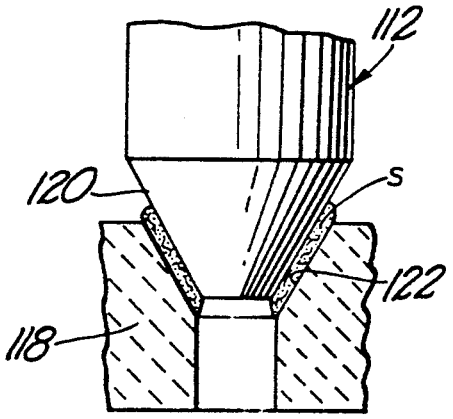
FIG. 8 is an enlarged fragmentary cross-sectioned view of the nozzle and stopper rod shown having slag build up.

A cable 238 extends between and is connected to the rod 222 of the LDT 216 and the stopper rod mounting bracket 113, as shown in FIG. 2, or to the stopper rod itself 112, as shown in the alternative embodiment of FIG. 6. In both embodiments, a pulley 240, 240' is mounted to the platform 234 forwardly of the rod 222 for supporting the cable 238 and transferring the vertical movement of the stopper rod 112 to the horizontally moveable sensor rod 222.

The fluid port 230 on the rod side of the piston is coupled to a pressurized fluid source 242, such as compressed air, through line 244 for continuously tensioning the cable 238 during pouring to eliminate any backlash in the cable raised by varying buoyancy forces on the stopper rod 112 or rapid movement of the stopper rod 112. The other fluid port 232 is vented to atmosphere. The air pressure supplied to the sensor 216 is preferably in the range of about 20 to 30 psi which is sufficient to maintain tension on the cable 238 and remove backlash, but is insufficient for controlling the movement of the stopper rod 112. That is, the pressurized LDT sensor 216 directly senses the movement of a stopper rod 112 but does not itself cause movement of the rod 112.

The cable 238 is preferably connected to the stopper rod assembly 112 at the pivot point connection $P_1$, as shown in FIG. 1. Connecting the cable 238 at this location enables the protective enclosure 236 and pulley 240 to be spaced to the side of the stopper rod 112 enabling the stopper rod 112 to be lifted vertically out of the vessel 114 past the enclosure 236 for servicing, without interference by the pulley 240 or enclosure 236. Since the mounting bracket 113 is rigidly connected to the stopper rod 112, the cable 238 is, in effect, mounted directly to the stopper rod 112. In this way, the LDT sensor 216 bypasses the linkage mechanism 116 and thus the inherent backlash enabling the LDT 216 to directly and accurately sense the actual movement and position of the stopper rod 112 without regard to the movement of the actuating rod 170.

The upper enclosure 236, 236' comprises a box-like structure surrounding the LDT 216 to define an enclosed space therein. To further protect the LDT 216 from the heat of pouring, the apparatus 100 is provided with cooling mean 246 for introducing a cooling medium into the enclosure 236 for cooling the LDT 216 during pouring. The cooling means 246 preferably comprises a vortex cooler which compresses air and injects it into the enclosure 236 at one end thereof adjacent the LDT 216 at a temperature of about 38°–40° F. The air exits through an opening 248 248' in the enclosure 236, 236' through which the cable 238 extends. In this way, the pulley 240 and cable 238 assembly are also cooled by the cooling medium. Of course, other cooling systems could be employed.

The apparatus 100 includes a programmable logic controller (PLC) 250 which forms a portion of the stopper rod feedback control system 214. The PLC 250 is programmed with pouring cycle information characteristic of a given casting mold for filling the mold at a prescribed rate. The mold fill rate can be expressed in terms of stopper rod position information (as in FIG. 7), since it is the position of the stopper rod 112 which regulates the flow of metal from the vessel 114 and hence the rate at which the mold 115 is filled. The PLC 250 is electronically coupled to the modulating valve 182 through line 254, to the LDT 196 through line 256, and to the LDT 216 through line 260. The PLC 250 is further coupled electronically to the secondary actuating valve 156 through line 260.

OPERATION

The stopper rod 112 is positioned at time $t_0$ in the fully closed condition against the nozzle 118 so that initially no metal flows through the nozzle 118. The LDT 216 senses the actual position of the stopper rod when fully closed and generates a signal which is received by the PLC representative of a zero reference position of the stopper rod 112 characteristic of the pouring cycle about to commence. This zero reference position is represented as $L_0$ in FIG. 7. The LDT 216 is thus zeroed for the upcoming pouring cycle.

The PLC 250 actuates the modulating valve 182 to force hydraulic fluid into the lower fluid inlet 178 forcing the actuating rod 170 upwardly which in turn pivots the intermediate lever 130 clockwise as shown in FIG. 2 forcing the housing 136 of the secondary actuating cylinder 134 upwardly in relation to the piston 138 and rod 14 until such time the stop surface 148 abuts the piston 138 The LDT 196 senses the position of the actuating rod 170 when the piston 138 and stop 146 are engaged and generates a signal to the PLC 250 representative of a zero reference position of the actuating rod 170. The LDT 196 is thus also zeroed for the upcoming pouring cycle.

Figure 4:
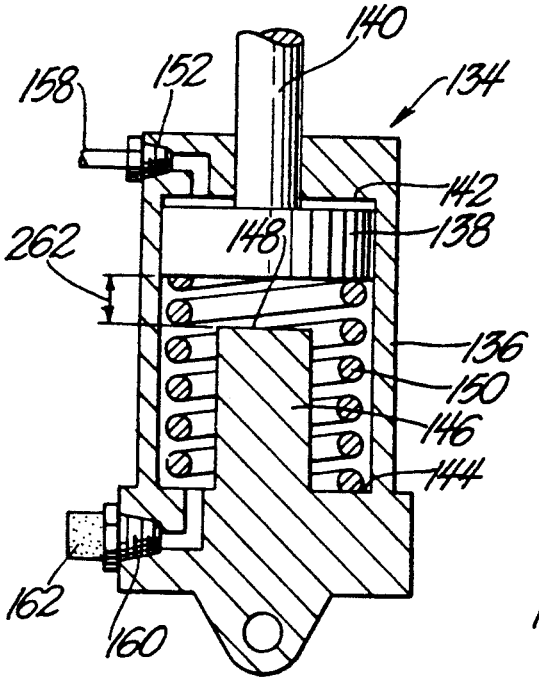
FIG. 4 is a cross-sectional elevational view of the secondary actuating mechanism.

The PLC 250 then sets an initial opening stroke or displacement of the stopper rod 112, represented at $L_1$ on the pouring schedule of FIG. 7, by actuating the modulating valve 182 to force the actuating rod 170 and hence the stop 146 downwardly in relation to the piston 138 of the secondary air cylinder 134. The compression spring 150 applies sufficient force to the piston 138 so that at this time the piston 138 and stopper rod 112 remain in position. The LDT 196 monitors the movement of the actuating rod 170 and signals the PLC 250 to stop movement when a predetermined gap 262 (FIG. 4) is developed between the piston 138 and stop surface 148. This gap 262 corresponds to the initial opening stroke $L_1$ of the stopper rod 112.

A casting mold 264 having a pouring basin 266, a mold cavity 268, and a feed gate 270 connecting the pouring basin 266 to the cavity 268 is moved into position below the vessel 214 as shown in FIG. 2. The mold 264 may be one of a sequential number of molds to be filled with the molten metal. When the mold 264 is in position, the PLC 250 signals the valve 156 to apply pressure to the upper port of the secondary actuating cylinder 134 which acts to quickly force the piston 138 down into engagement with the stop 146 an concurrently raises the stopper rod 112 to the initial open position $L_1$ through action of the first linkage formed by levers 124, 126 at time $t_1$. Opening the stopper 112 allows the molten metal M in the vessel 14 to flow by gravity through the nozzle 118 at the predetermined flow rate into the pouring basin 266 of the mold 264 below. Initial flow of metal is thus initiated by actuating the pneumatic cylinder 134 which thereafter remains pressurized during the entire pouring cycle forming a rigid mechanical connection between levers 124 and 130. Immediately following the initial opening operation, the primary actuating cylinder 164 takes over to control the positioning of the stopper rod 112 for the remainder of the pouring cycle.

The pouring rate of the metal is controlled in such a way as to maintain a predetermined level of metal in the pouring basin 266 during the pouring cycle which, in turn, controls the rate at which the mold cavity 268 is filled to achieve optimum casting quality. The initial pouring rate is very high in order to quickly fill the basin 266. Once filled, the stopper rod 112 is lowered (to $L_2$) to maintain the desired metal level in the basin 266 throughout the remainder of the cycle. A metal level sensor in the preferred form of an electronic imaging sensor 272 is provided for monitoring the level of metal in the pouring basin 266 at all times and generating feedback information to the PLC 250 instructing the PLC to raise or lower the stopper rod 112 for adjusting the flow rate of the metal in order bring the metal level into conformance with the pouring schedule. For example, when the level sensor 272 senses that the metal in the basin 266 has reached the prescribed level, it signals the PLC 250 to decrease metal flow. The PLC 250 responds by controlling the hydraulic cylinder 164 via the modulating valve 182 in order to lower the stopper rod 112 to corresponding position of adjustment (e.g., $L_2$) with respect to the fully closed zero reference position $L_0$ of the stopper rod 112. The LDT 216 directly measures the actual movement and position of the stopper rod 112 unhindered by the inaccuracies of the various pivot connections P1–P6 of the linkage mechanism 216 and sends representative feedback information to the PLC 250 which, in turn, sends corrective control signal information to the modulating valve 182 in the form of increasing or decreasing voltage in order to bring the actual stopper rod position into conformance with the target reference position as determined by the pouring schedule.

As the mold cavity 268 approaches the fully filled condition, the metal level in the basin 266 will suddenly begin to rise. The level sensor 272 senses this condition and signals the PLC 250 to control the valve 156 so as to rapidly exhaust the air from the cylinder 134 causing the compression spring 150 to extend thereby forcing the piston 138 and rod 140 upwardly and forcing the stopper rod 112 downwardly into seating engagement with the nozzle 118 to stop pouring At this point, the pouring cycle is complete and the LDT sensors 196 and 216 will be rezeroed for the next cycle in the same manner as described above.

Over time, slag S and other impurities tend to deposit on the seating surface 122 of the nozzle 118. Such a condition may not affect the ability of the stopper rod 112 to stop metal flow through the nozzle 118, but it will cause the position of the stopper rod 112 to change when in the fully closed condition. In other words, the fully closed zero reference position may change from casting cycle to casting cycle due to slag build up S. The method of the present invention accounts for such changes by rezeroing the position sensors 196 and 214 prior to commencing each new cycle. FIG. 7 illustrates how the control system compensates for slag build up S by shifting the pouring curve upwardly (broken lines) by an amount equal to the slag build up S so that the relative displacement of the stopper rod 112 remains unchanged. In this way, precise control of the stop pour rod position and hence the flow rate can be maintained even though casting conditions change.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. An apparatus for controlling molten metal discharge through a nozzle of a bottom pouring vessel, said apparatus comprising:

a stopper rod (112);

linkage means (116) supporting said stopper rod (112) for axial movement relative to the nozzle;

primary actuating means (132) coupled to said stopper rod (112) by said linkage means (116) for raising and lowering said stopper rod (112) to positions relative to the nozzle in response to moving said actuating means (132) to corresponding positions for regulating the flow of molten metal through the nozzle into an underling casting mold;

and stopper rod feedback control means (214) for sensing the actual position of said stopper rod (112) with respect to the nozzle and irrespective of the position of said actuating means (132) and controlling movement of said actuating means (132) for conforming the actual stopper rod position with a target reference position of said feedback control means (214) to compensate for any backlash present in said linkage means (116).

2. An apparatus as set forth in claim 1 wherein said stopper rod feedback control means (214) includes a stopper rod position sensor (216) for continuously sensing the actual stopper rod position and generating representative stopper rod feedback information.

3. An apparatus as set forth in claim 2 wherein said stopper rod position sensor (216) comprises a linear displacement transducer.

4. An apparatus as set forth in claim 2 wherein said stopper rod feedback control means (214) includes a programmable controller (250) coupled electronically to said position sensor (216) for receiving and comparing the representative feedback information with the target reference position and sending corrective control signal information to said actuating means (132) for controlling the movement of said actuating means (132) and making corrective adjustments to the actual stopper rod position to bring the actual stopper rod position into conformance with the target reference position.

5. An apparatus as set forth in claim 4 including metal level sensing means (272) coupled electronically to said programmable controller (250) for sensing the level of metal in the mold and signaling the programmable controller (250) for adjusting the position of the stopper rod (112) and thereby the flow rate of metal into the mold for bringing the metal level in the mold into conformance with a target reference metal level of the controller (250).

6. An apparatus as set forth in claim 5 wherein said metal level sensor (250) comprises an electro-optical sensor.

7. An apparatus as set forth in claim 2 including cooling means (246) for cooling said stopper rod position sensor (196).

8. An apparatus as set forth in claim 2 wherein said stopper rod position sensor (216) is connected directly to said stopper rod (112).

9. An assembly as set forth in claim 8 including a flexible inelastic cable (238) interconnecting said stopper rod position sensor (216) and said stopper rod (112).

10. An assembly as set forth in claim 9 including a pulley (240) supporting said cable (238).

11. An apparatus as set forth in claim 10 including tensioning means for tensioning said cable (238) during operation of said stopper rod position sensor (216).

12. An apparatus as set forth in claim 11 wherein said tensioning means comprises a pressurized fluid actuating cylinder formed integrally with said stopper rod position sensor (216).

13. An apparatus as set forth in claim 12 wherein said stopper rod position sensor (216) is mounted above said stopper rod (112) and being housed within a protective enclosure (236) and includes cooling means (246) for introducing a cooling medium into said enclosure (236) for cooling said stopper rod position sensor (216).

14. An apparatus as set forth in claim 13 wherein said enclosure (236) is spaced laterally from said stopper rod (112) for enabling said stopper rod (112) to be raised vertically past said enclosure (236).

15. An apparatus as set forth in claim 3 wherein said actuating means (132) comprises a fluid power actuator.

16. An apparatus as set forth in claim 15 including a electronic modulating valve (182) coupled to said actuator (132) and said programmable controller (250).

17. An apparatus as set forth in claim 16 wherein said fluid actuator (132) includes a housing (166), a piston (168) slideably disposed inside said housing (166), an actuating rod (170) secured to said piston (168) and having portions (172, 174) there of extending from opposite sides of said piston (168) through the housing (166), said rod being connected to said linkage means (116).

18. An apparatus as set forth in claim 17 including actuating rod position sensing means (196) connected in parallel to said fluid actuator (132) and coupled electronically to said programmable controller (250) for sensing the position of said actuating rod (170) and sending representative feedback information to said programmable controller (250).

19. An apparatus as set forth in claim 18 wherein said actuating rod position sensing means (196) comprises a linear displacement transducer.

20. An apparatus as set forth in claim 17 wherein said portions (172, 174) of said actuating rod (170) have equal cross-sectional sizes within said housing (166).

21. An apparatus as set forth in claim 3 wherein said linkage means (116) includes a first linkage connected pivotally to both said stopper rod (112) and a stationary support structure (128), a second linkage connected pivotally to both said actuating means (132) and said support structure (128), and secondary actuating means (134) interconnecting said first and second linkages for enabling selective pivotal movement of said first linkage independently of the movement of said second linkage when said secondary actuating means (134) is in an operative condition and for forming a direct mechanical rigid connection between first and second linkages when said secondary actuating means (134) is in an inoperative condition for transmitting motion between said first and second linkages enabling said primary actuating means (132) to Control movement of said stopper rod (112).

22. An apparatus as set forth in claim 21 wherein said secondary actuating means (134) comprises a pneumatic cylinder having a piston (138) coupled to one of said linkage means (116) and said primary actuating means (132), and a housing (136) coupled to the other of said linkage means (116) and said primary actuating means (132).

23. An apparatus as set forth in claim 22 wherein said first linkage includes an upper lever (124) having opposite ends and connected pivotally to said stopper rod (112) at one of said ends and connected pivotally to the support structure (128) intermediate said ends, the other of said ends being coupled to said secondary actuating means (134).

24. An apparatus as set forth in claim 23 wherein said first linkage includes a lower lever (126) having opposite ends connected pivotally to said stopper rod (112) and said support structure (128).

25. An apparatus as set forth in claim 24 said second linkage includes an intermediate lever (130) having opposite ends and connected pivotally to said support structure (128) at one of said ends and the connected pivotally to said primary actuating means (132) at the other of said ends.

26. An apparatus as set forth in claim 25 wherein said secondary actuating means (134) is connected pivotally to said intermediate lever (130) at a location between the ends of said intermediate lever (130) and pivotally to the other end of said upper lever (124) for establishing a connection between said upper lever (124) and said intermediate lever (130).

27. A method for controlling the pour of molten metal into molds utilizing a bottom pour casting apparatus including a pouring vessel (114) provided with a bottom nozzle (118), a stopper rod (112) extending into said vessel (114) for communicating with the nozzle (118), and a stopper rod control mechanism which is programmable for raising and lowering the stopper rod (112) in relation to a zero reference position of the stopper rod (112) corresponding to a fully closed condition of the stopper rod (112) wherein the stopper rod (112) is seated against the nozzle (118), said method comprising the steps of:

sending the actual position of the stopper rod (112) with respect to the nozzle (118) when in the fully closed condition before each pouring cycle commences and sending a representative signal to the control mechanism characteristic of each pouring cycle;

and thereafter actuating the stopper rod control mechanism and controlling the movement of the stopper rod (112) in relation to the characteristic zero reference position for each pouring cycle.

* * * * *